US009089235B2

(12) United States Patent
Thornton

(10) Patent No.: US 9,089,235 B2
(45) Date of Patent: Jul. 28, 2015

(54) SUPPLEMENTAL CONTAINER TRAY

(76) Inventor: Thomas H. Thornton, Ballwin, MO (US)

( * ) Notice: Subject to any disclaimer, the term of this patent is extended or adjusted under 35 U.S.C. 154(b) by 316 days.

(21) Appl. No.: 13/507,591

(22) Filed: Jul. 12, 2012

(65) Prior Publication Data

US 2013/0015097 A1 Jan. 17, 2013

Related U.S. Application Data

(60) Provisional application No. 61/572,126, filed on Jul. 12, 2011.

(51) Int. Cl.
*B65D 1/36* (2006.01)
*A47G 23/06* (2006.01)

(52) U.S. Cl.
CPC ..... *A47G 23/0641* (2013.01); *B65D 1/36* (2013.01)

(58) Field of Classification Search
CPC ..... B65D 1/36; A47G 23/0641
USPC ..... 206/557, 560–565; 220/507, 509, 513, 220/515, 516, 518, 574, 574.3, 575, 737; 211/74
See application file for complete search history.

(56) References Cited

U.S. PATENT DOCUMENTS

| | | | | |
|---|---|---|---|---|
| 1,757,689 | A * | 5/1930 | Strickland | 206/562 |
| 2,709,904 | A * | 6/1955 | Boughton | 220/575 |
| 5,171,077 | A * | 12/1992 | Jondahl et al. | 312/249.3 |
| 5,624,043 | A | 4/1997 | Baptista | |
| 5,704,495 | A | 1/1998 | Bale et al. | |
| 5,996,802 | A * | 12/1999 | Parker et al. | 206/563 |
| 6,109,580 | A | 8/2000 | Stern et al. | |
| 6,156,275 | A | 12/2000 | Dumitrescu et al. | |
| 6,286,678 | B1 * | 9/2001 | Petrek | 206/562 |
| 6,345,723 | B1 | 2/2002 | Blake et al. | |
| 7,542,910 | B2 | 6/2009 | Kellough et al. | |
| D618,091 | S | 6/2010 | Bizzell | |
| 8,186,538 | B2 * | 5/2012 | MacCarthy | 220/737 |
| 2007/0029331 | A1 * | 2/2007 | George et al. | 220/574 |
| 2007/0205190 | A1 * | 9/2007 | Yang | 220/575 |
| 2008/0202976 | A1 * | 8/2008 | Burgess et al. | 206/564 |
| 2011/0132914 | A1 * | 6/2011 | Vernes et al. | 220/575 |
| 2012/0273384 | A1 * | 11/2012 | Jaswal | 206/563 |

* cited by examiner

*Primary Examiner* — Luan K Bui
(74) *Attorney, Agent, or Firm* — Paul M. Denk

(57) ABSTRACT

A molded rubber or polymer extrusion in the form of a supplement tray designed to fit onto the standard restaurant tray of varying sizes. The supplemental tray is designed to sit upon the surface of the tray, and through various annuluses, an upwardly extending retention means, for holding beer cans and bottles in place during there delivery or removal during usage.

4 Claims, 3 Drawing Sheets

SUPPLEMENTAL CONTAINER TRAY

CROSS REFERENCE TO RELATED APPLICATION

This non-provisional patent application claims priority to the provisional patent application having Ser. No. 61/572,126, filed on Jul. 12, 2011.

FIELD OF THE INVENTION

The present invention relates to a flexible or semi-rigid covering, in the form of a Supplemental Container Tray, which may be used in conjunction with a serving tray, which provides support for the containment of bottles or other containers as being delivered to and from customers.

BACKGROUND OF THE INVENTION

Obviously, various types of serving trays have long been used in the culinary arts, and there are numerous devices, in the form of trays, to facilitate the transport of and delivery of bottles, cans, or even as used in the delivery of food to a table, but which may have supplemental usage for the delivery of containers of a beverage, or for the collection of the same, after consumption. There also exists many different types of serving trays in the prior art. What the prior art does not address is the specific problem of how to handle full or empty beer bottles, or cans, or containers, before or after consumption, and such is a constant nuisance to the waiter, and difficult to remove by the busboy, using a standard serving tray. Empty beer bottles are not steady, and can be easily tipped when being removed from a restaurant service area. There does not appear to be any prior art that specifically provides for the utility in addressing this specific issue, of removing the spent containers, from the table, after usage.

The prior art known to the applicant includes a wine bottle holding device, acting as a supporting and serving tray, as can be seen in U.S. Pat. No. 5,624,043.

The patent to Bale, et al, U.S. Pat. No. 5,704,495, shows a releasable restraining device, wherein apparently the top of a bottle may be held in position upon the shown rack.

The patent to Stern, et al, U.S. Pat. No. 6,109,580, shows a food and beverage tray supportable by a cup holder, which apparently can be inserted within a cup holder as within a vehicle, or chair, and then hold other cups and food or other products, within its tray body.

The patent to Dumitrescu, et al, U.S. Pat. No. 6,156,275, shows a sample tube rack, which apparently can hold tubes, like test tubes, for sampling purposes.

The patent to Blake, et al, U.S. Pat. No. 6,345,723, shows an upright and inverted bottle and container holder for contents availability.

The patent to Kellough, et al, U.S. Pat. No. 7,542,910, shows a method and apparatus for serving beverages and for concealing and storing waitresses' cash. This is tray that has a slot with a covered compartment thereunder, and into which tips may be inserted, for concealment and safety.

Finally, the design patent to Bizzell, No. D618,091, shows a cover for a serving tray.

SUMMARY OF THE INVENTION

This invention relates to a supplemental tray for allowing principally for delivering of bottles or for securement of spent containers, such as bottles, when removing them from the customers' table.

In view of the difficulty that servers have in delivering and removing bottles, using the standard serving tray, the current invention provides a simple mechanism to support bottles, and retain them, during transport into and out of a service area. The general purpose is to make a bottle support easier for servers and to allow for fewer drops of glass bottles in a restaurant or bar environment.

The current invention comprises a supplemental tray, that may be applied onto a serving tray, such as by securing it around its periphery, or at least having a retaining lip that can hold the supplemental tray into position, or which just may be inserted, without retention, to one end of the standard serving tray, to provide a means for grasping of spent bottles, or other containers, during their removal or delivery from or to customers' table.

A further preferred embodiment for this invention may include an annulus having a series of apertures provided therein, and into which bottles may be inserted, and held in position, by means of fingers, to secure the bottles to the annulus, and the tray, during their transit. And, the annulus may include friction means to hold the annulus on to the tray during its usage.

It is, therefore, the principal object of this invention is to provide a unique mechanism, in the form of a supplemental tray, that can be used for holding and transporting bottles while using the standard bar or restaurant serving tray.

It is a further object of the present invention to provide a tray which is easy to manufacture, easy to clean, durable, and useful to aid in the transport of bottles, cans, and the like, and therefore minimize and reduce the incident of broken bottles in a restaurant environment, due to spillage.

A further object of the invention is to provide a supplemental tray that can easily be attached or removed from a standard serving tray, one that provides a server with assistance to support the difficult effort of trying to balance empty bottles, when removing them from a table, or while delivering a variety of beer bottles, or cans, to a customers' table, during service.

Still another object of this invention is to provide a flexible, lightweight plastic, rubber, or other flexible material that may be place on top of a serving tray, and which may be held in place by an extension of a lip of material that folds about or clamps onto the peripheral edge of the standard serving tray.

Another object of this invention is to provide a supplemental tray that has upstanding gripping means, whether it is in the form of arcuate upstanding protrusions, or fingers, that can grip a bottle during its delivery or removal during service.

Another object of this invention is to provide a supplemental tray that may be manufactured to various sizes, to accommodate and be applied to all the variations in size and shape of the serving trays that are currently being manufactured and used in a restaurant and bar setting.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
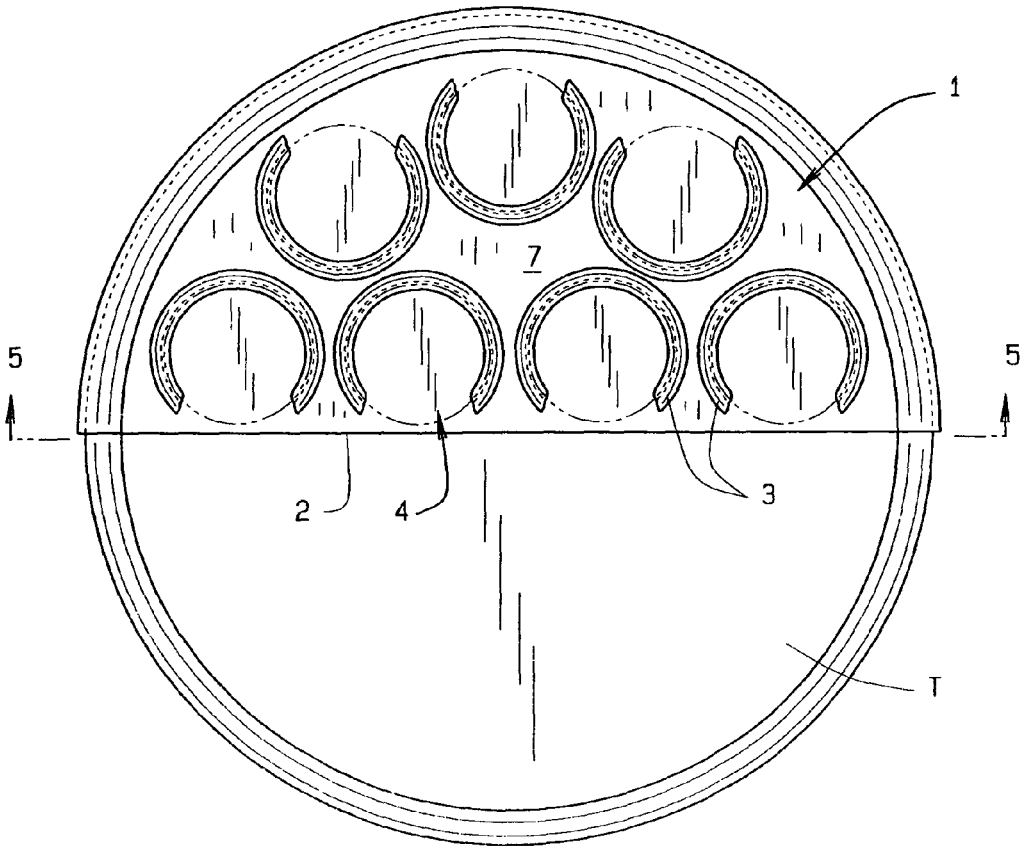
FIG. 1 presents a top view of the Supplemental Container Tray of this invention, showing resting upon the standard serving tray, as during usage.

In referring to the drawings, and in particular FIG. 1, therein is shown the Supplemental Container Tray 1 of this invention. It includes a tray that may be of partial size for overlying a portion of the standard serving tray T, as can be noted, in this particular instance, it is shown as being semicircular of design, extending generally at its center edge 2 along the diameter of the standard serving tray T. This supplemental tray may be molded of a polymer, formed of rubber, and includes a series of upstanding retention means 3 which will extend upwardly for a sufficient distance to allow for the retention means to grip the bottom of any bottle, can, or other container, during its usage. As can be noted, each of the retention means extends for a partial circumference, generally approximately 270° in circumference, as can be noted, and each retention means has an entrance slot 4 and through which a bottle may be inserted, and held into position by means of the gripping aspects of the retention means, during usage.

Obviously, while the supplemental tray may be shown as overlying approximately half of the disclosed serving tray T, it my take other shapes, or be of lesser dimensions, or it may only just sit upon a portion of the tray T, during its usage. In any event, regardless of its size, shape, or dimensions, it is provided for allowing for the retention of bottles, during their delivery, or when being removed, making the task for the server much more facile, knowing that there is little likelihood that the bottle may tip over, as can frequently occur when they are conveyed to a table, by simply standing independently upon the standard serving tray.

Figure 2:
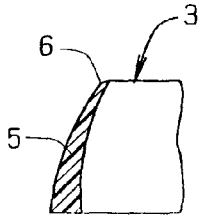
FIG. 2 is a sectional view taken through one of the retention rings to show the inward arcuate curve of its retainer.

Generally, the retention means 3, as noted, can be seen in cross section in FIG. 2. As disclosed, it includes an upstanding protrusion or rim, as at 5, which will be molded of reasonably flexible polymer or rubber, and be somewhat arcuate of shape, extending inwardly, to its upper tip 6, as can be noted. Thus, when a bottle is slid into the retention means, the upper tip 6 will be biased outwardly, and generally grip the periphery of the bottle, to hold it in position. These retention means 3 will be molded with the base 7 of the supplemental tray, so that even the base of the tray may have some inherent resiliency, but sufficiently sturdy to allow for its resting upon the standard serving tray, and to function as a means for retaining a plurality of bottles, such as the representative 7 retention means as noted for the supplemental tray as disclosed in FIG. 1. Obviously, other numbers of retention means can be used, or less, depending upon the circumstances.

Figure 3:
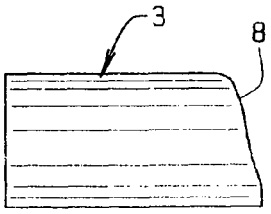
FIG. 3 is a side view of one of the retention means of the invention.
Figure 4:
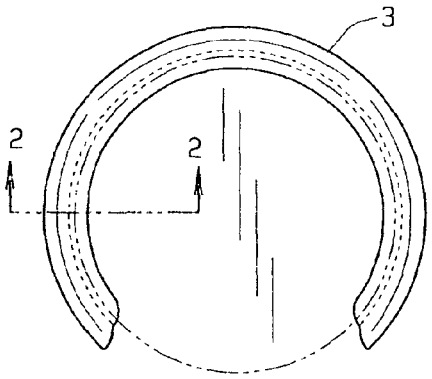
FIG. 4 is a top plan view of one of the retention rings of this invention.

FIG. 3 provides a side view of one of the retention means 3, and it can be noted that the cutaway section as at 4, has a slight rearward incline, as at 8, so as to facilitate the sliding of a bottle therein, as it biases the protrusion 5 outwardly, to allow the bottle to slid into engagement, and set within the retention means, during its processing. All of these components can generally be seen in FIG. 4, which is similar to the disclosure of the retention means 3, as noted in FIG. 1.

It may be commented that while the retention means is shown as a partial circumferential molded retainer that extends for some degree around the perimeter of the bottle socket, it is just as likely that three or more fingers, formed as retention means, could be molded as a method for holding a bottle in place, upon the surface of the base 7 for the supplemental tray, as can be understood.

Generally, the concept of the invention is to provide the surface for the supplemental tray that would have a series of protrusions extending upwardly, either in a semicircular manner, or in the format of a series of fingers, that have some resiliency, that allows for easy placement and removal of bottles, cans, or the like, during their serving, of when removing when spent. The protrusions would extend upwardly enough to provide support for the bottles to deter the bottles from tipping, or falling over during their transport. The material forming the supplemental tray, and its retention means, would provide enough give to allow for the easy insertion, full support, and easy removal of the bottles or containers, during their processing.

Figure 5:
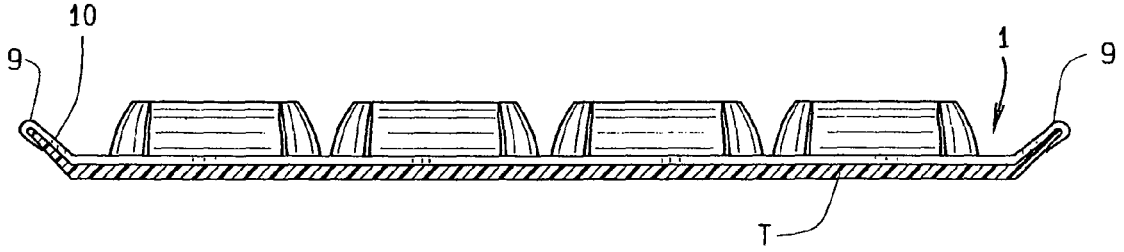
FIG. 5 is a front view of the Supplemental Container Tray of this invention, shown engagement with the standard serving tray.

FIG. 5 provides a cutaway side view of the Supplemental Container Tray 1 of this invention, shown being attached to the standard serving tray T, during its usage. It is likely that where the supplemental tray may be formed of an equivalent shape to a part of the tray T, there may be a lip, as at 9, provided around its circumference, so that it may be capable of griping the edge of the standard tray T, as can be noted. Or, it may be sufficient that simply having an inclined portion 10 for the supplemental tray, without the lip 9, may be sufficient to hold the supplemental tray in position, upon the standard tray T, during its usage. Or, it might be that simply using a supplemental tray 1, without any lip, or inclined portion 10, but simply resting it upon a part surface of the tray T, may be sufficient stability to allow for the bottles to be inserted and gripped within their retention means, and removed, for disposal.

A preferred embodiment of the current invention includes the use of an annulus, generally fabricated of polymer material, preferably material that will have some resiliency to it, and in this particular instance, the annulus 11 includes a series of apertures, as at 12 and 13, which may be equivalent to, or even slightly smaller, than the diameter of any bottle to be located therein, during usage of this supplemental trade. In the case of the apertures 13, they may be slightly larger than the diameter of any bottle, and have at least one finger 14 extending internally thereof, and which will bias tightly against the outside surface of any bottle located therein, in order to embrace it, hold it in position, and to prevent it from tipping while being conveyed. This may be done either when the full beer or other beverage bottles are being conveyed to the table, or when the empties are being returned, after consumption. The annulus may include a hand hold area 15 that facilitates the user's efforts to maintain this container tray upon a serving tray, similar to that as previously explained with respect to FIG. 1. In addition, the underside of the annulus may include a series off friction means, as noted at 16, and which may be useful for positioning and holding the annulus onto a serving tray, such as the tray fingers or teeth, as previously explained.

The annulus of this invention may be fabricated from the polymer, such as polyethylene, styrene or high density styrofoam, or more preferably, may be formed of EVA, an ethylene vinyl acetate, generally formed of a number four closed cell, to have sufficient rigidity to hold the bottles in place, but have enough resiliency, at the position of the fingers 14, to bias against the bottles and secure them in position, once inserted. In addition, the resilient teeth or fingers 14 obviously will allow for the insertion of bottles having slightly different diameters, because of the resiliency of the fingers 14, in its integral construction within the formed annulus. For example, just one finger 14 within each aperture may be sufficient to hold bottles of different diameter in position, when they are inserted therein. More specifically, the diameter of the aperture 12 may be approximately 66 mm in dimension. Or, where the annulus 13 is used, it may be 60 mm in diameter, when measuring across the aperture diameter from the inner surface of one finger to another. The tray may be about 320 mm in diameter, and about 20 mm thick.

Figure 6:
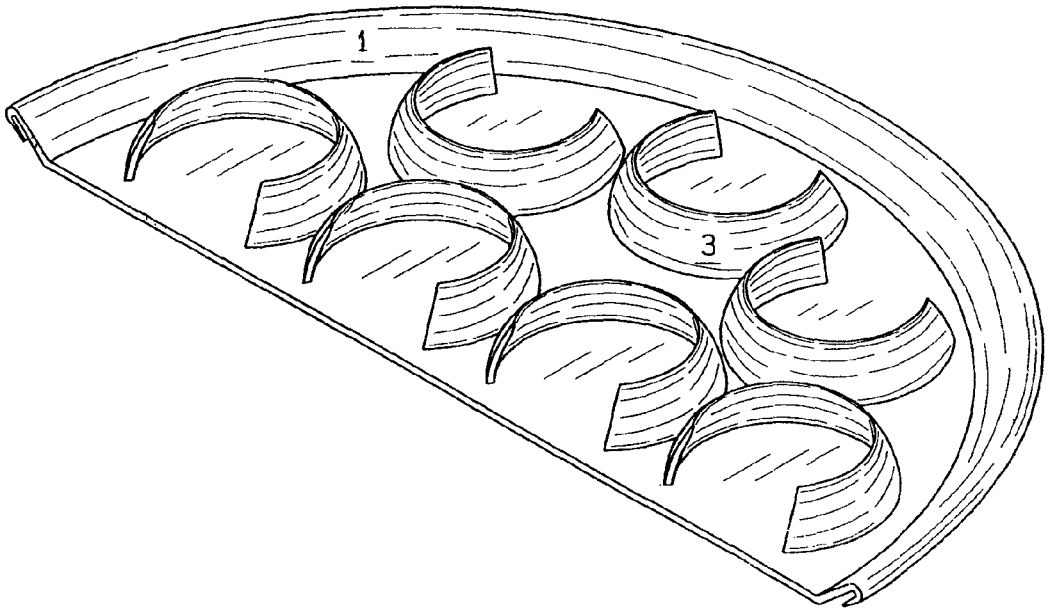
FIG. 6 is an isometric view of the Supplemental Container Tray of this invention.
Figure 7:
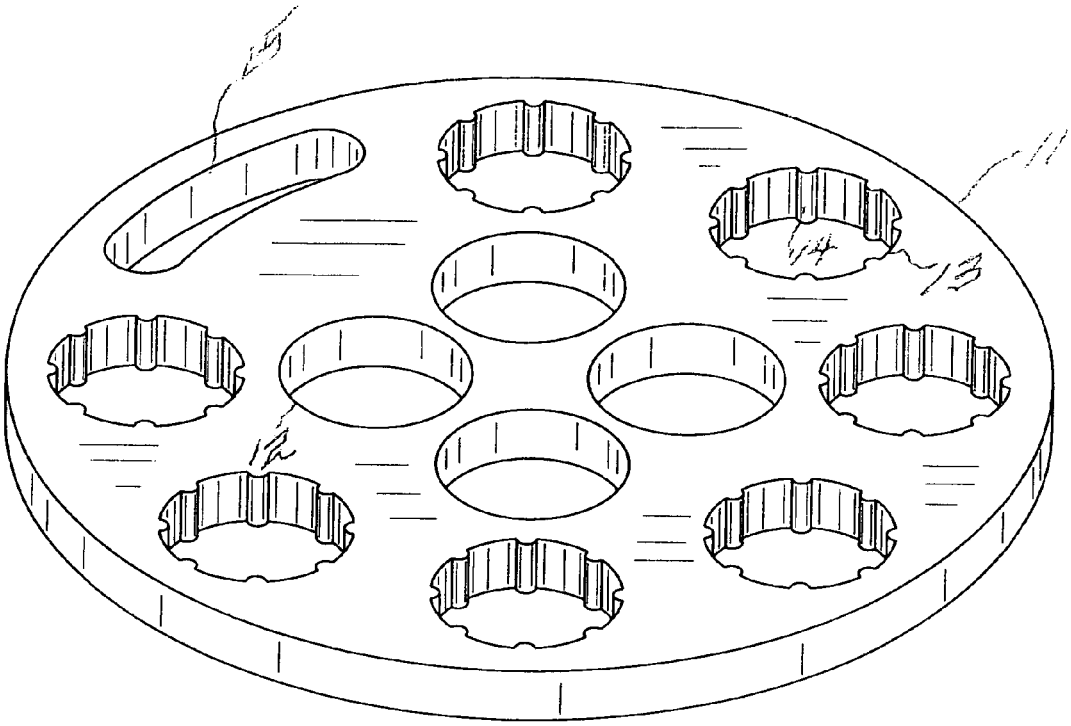
FIG. 7 is an isometric view showing the top of the Supplemental Container Tray of this invention.
Figure 8:
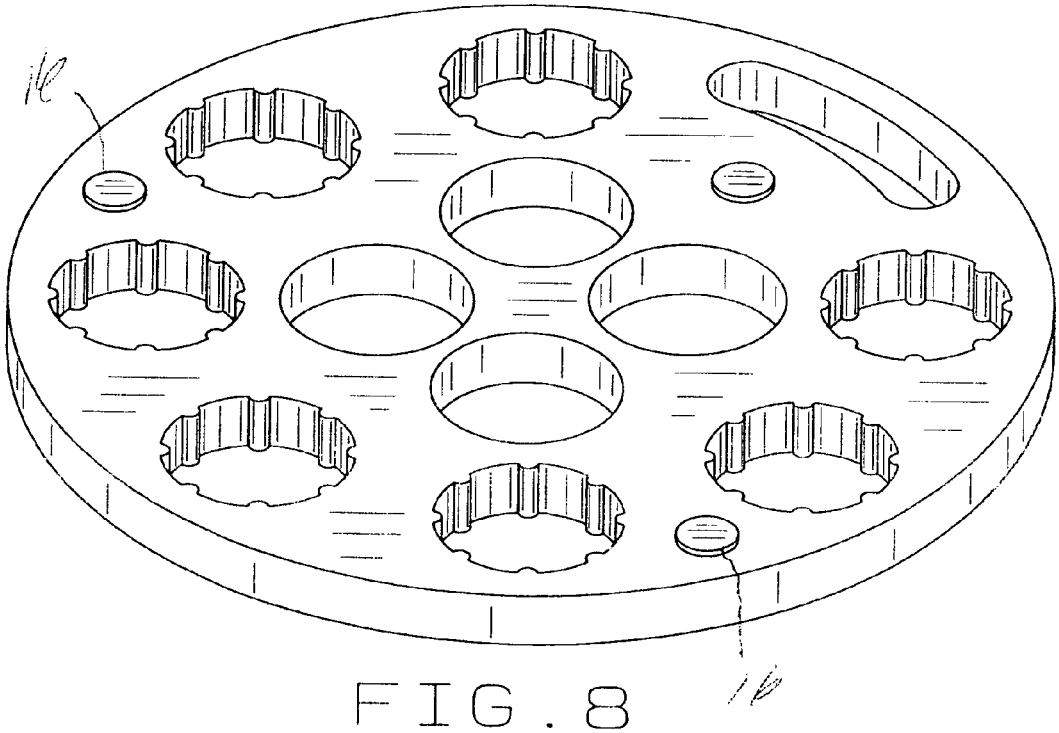
FIG. 8 is an isometric bottom view of the Supplemental Container Tray.

FIG. 6 shows an isometric view of the formed supplemental tray 1, with its variety of retention means 3, as formed, molded, and readied for usage. These retention means may be a softer type of polymer, which may be adhesively applied to the underside of the supplemental tray, while the opposite side, which adheres against the tray, may provide sufficient friction to hold the supplemental tray in place.

There are many polymers that may be molded into the configuration of this supplemental tray, the amount of resiliency formed into the material, and for its retention means 3, can be determined by the molder, when such trays are being formed, for commercialization.

Variations or modifications to the subject matter of this invention may occur to those skilled in the art upon review of the disclosure as provided herein. Such variations, if within the spirit of this invention, are intended to be encompassed within the scope of any claims to patent protection issuing upon this development. The description of the invention as set forth herein, and its depiction in the drawings, are generally set forth for illustrative purposes only.

I claim:

1. A supplemental container tray for use with a standard serving tray and for application contiguously thereon during usage, comprising:

said supplemental container tray being of an approximately semicircular design for fitting within a partially covering a standard serving tray;

said supplemental container tray having a base portion, a series of integral upstanding retention means extending upwardly from said base portion, said retention means having sufficient inherent resiliency to allow for the retention of the proximate bottom of a container applied into the retention means and to retain the container during insertion, or until the container is removed therefrom, as during usage of the supplemental container tray, said retention means being of an arcuate design and having ends, said ends providing an entrance slot having sufficient width to allow for a container to be inserted therein or removed therefrom and for securement of a container by said retention means during usage of the supplemental container tray, each arcuate retention means including an upstanding rim, and each rim having an upper tip, with the rim having an inward extension extending from the base portion to the upper tip of each arcuate retention means, and thereby grasps the bottom of a container applied therein during service or removal from a customer location; and said supplemental container tray including an inclined outer edge provided around the a segment of perimeter of the approximate semicircular design, to allow for the continuous positioning of the supplemental container tray within a standard tray, and to add stability to the usage of the supplemental container tray during its application.

2. The supplemental container tray of claim 1 wherein said inclined edges includes a downward lip, the downward lip of said supplemental tray capable of interconnecting with the edge of the standard tray, to add to its retention when the supplemental tray is positioned within a standard tray, for use in the processing of beverage containers.

3. The supplemental container tray of claim 1 and including frictioning means provided upon the bottom of the approximate semicircular base of the supplemental container tray to effect its adherence to the serving tray during usage.

4. The supplemental container tray of claim 1, wherein said supplemental container tray has resiliency.

* * * * *